US005152710A

United States Patent [19]

Montgomery

[11] Patent Number: 5,152,710

[45] Date of Patent: Oct. 6, 1992

[54] FOLD OPEN PLAY SET WITH SLOTTED BASE

[75] Inventor: Robert B. Montgomery, Canterbury, England

[73] Assignee: Hornby Hobbies Limited, Kent, England

[21] Appl. No.: 694,317

[22] Filed: May 3, 1991

[51] Int. Cl.[5] ..... A63H 33/04; A63H 33/06; B65D 5/50; B65D 6/00

[52] U.S. Cl. ..... 446/75; 446/118; 220/4.23; 220/4.24; 206/45.15; 206/427

[58] Field of Search ..... 446/75, 76, 77, 79, 446/80, 71, 128, 109, 114, 115, 116, 118, 149, 476, 478, 479; 273/241, 285, 286, 287, 313; 206/45.14, 427; 220/4.22, 4.23, 4.24

[56] References Cited

U.S. PATENT DOCUMENTS

| | | | |
|---|---|---|---|
| Re. 26,642 | 8/1969 | Bender | 446/478 |
| 1,340,047 | 5/1920 | Hansen | 446/478 |
| 1,449,519 | 3/1923 | Layton | 446/115 X |
| 1,493,277 | 5/1924 | Pool | 446/71 |
| 1,941,538 | 1/1934 | Costello | 446/80 X |
| 2,682,727 | 7/1954 | Keljik | 446/83 |
| 2,871,619 | 2/1959 | Walters | 446/110 |
| 3,032,919 | 5/1962 | Amsler | 446/116 X |
| 3,902,598 | 9/1975 | Koob et al. | 220/4.23 X |
| 4,030,235 | 6/1977 | Terzian et al. | 446/296 |
| 4,060,173 | 11/1977 | Dahl | 220/4.23 |
| 4,130,284 | 12/1978 | Fuks | 273/285 X |
| 4,349,983 | 9/1982 | Kilroy et al. | 446/76 X |
| 4,753,347 | 6/1988 | Bellante et al. | 206/472 X |
| 4,759,838 | 7/1988 | Mayes et al. | 220/4.23 X |
| 4,781,384 | 11/1988 | Bois | 206/472 X |
| 4,966,283 | 10/1990 | Sykes et al. | 206/472 X |
| 5,013,278 | 5/1991 | Dixon et al. | 446/219 X |
| 5,055,083 | 10/1991 | Walker et al. | 446/71 X |
| 5,069,332 | 12/1991 | Williams et al. | 206/45.14 X |

FOREIGN PATENT DOCUMENTS

| | | | |
|---|---|---|---|
| 700976 | 12/1964 | Canada | 446/75 |
| 807582 | 7/1951 | Fed. Rep. of Germany | 446/80 |
| 3916668 | 12/1989 | Fed. Rep. of Germany | 220/4.23 |
| 1001406 | 2/1952 | France | 446/118 |
| 438944 | 6/1949 | Italy | 446/118 |
| 288766 | 2/1953 | Switzerland . | |
| 8581 | 5/1903 | United Kingdom | 446/75 |
| 1436453 | 5/1976 | United Kingdom | 273/285 |
| 2010102 | 6/1979 | United Kingdom . | |

*Primary Examiner*—D. Neal Muir
*Attorney, Agent, or Firm*—Watson, Cole, Grindle & Watson

[57] ABSTRACT

A play system for enabling a construction to be built has a base plate, the base plate having a plurality of slots in the main surfaces thereof. A container for a toy or game, in the form of a box having two parts hinged together, can be mounted on the base plate. At least one of the parts of the box has a main wall with an edge portion which can be located in one of the slots in the base plate, whereby said container can form one or more walls for the construction.

20 Claims, 6 Drawing Sheets

FOLD OPEN PLAY SET WITH SLOTTED BASE

BACKGROUND OF THE INVENTION

The present invention relates to a play system and, more particularly, to a play system which enables the building of toy constructions such as dolls' houses and the like.

Many different types of play system exist. For example, at one end of the spectrum of such systems there are straightforward construction systems such as Lego® and Meccano®, whilst at the other end there are conventional dolls' houses, toy garages, etc. In between there are systems which involve the construction of specific buildings and the like from a kit of parts for use with particular dolls or toy creatures.

Generally, the packaging in which such play systems are sold provides a container for the system or component parts of it, but forms no part of the play system in use. It is known to use containers for games and other toys as part of the game or toy, however, but such containers are of fixed configuration and provide only limited play value.

SUMMARY OF THE INVENTION

The present invention has, as one object, the provision of a system which provides a container which can not only be used to house a toy or game (for example providing the packaging for it), but which can also be used in modular fashion to form a construction which then becomes an integral part of the play system.

According to a first aspect of the present invention there is provided a play system having a base plate in the surface of which are provided a plurality of slots; and, a container for a toy or game, the container comprising a box which has two parts hinged together, at least one of the parts having a main wall with an edge portion which can be located in one of the slots in the base plate in order that the container can form one or more walls for a construction which can be built on the base plate.

Preferably, the container will contain play items such as a doll together with accessories which may form items associated with the doll, although it is envisaged that some containers may contain only accessories which may fit with those of another style of container to provide additional components for a single room or area to be formed in the construction.

Preferably, the base plate is generally rectangular and has plural sets of slots arranged orthogonally, parallel to the major sides of the base plate. The base plate may have slots in both major surfaces and may include complementary coupling parts whereby two or more base plates may be connected together in a plane to provide a larger floor, roof or the like.

The container preferably has two halves, each of which may include side flanges which, when the box is closed, together form side walls of the container, and main walls which lie opposite one another when the box is closed. The main walls are preferably connected by a spine wall which is hinged to both main walls to allow the box to open.

It is preferable if the side walls on opposite halves engage one another to fully close the container and this may be achieved, in a similar way as in a video cassette container, by providing a single edge recess in one engaging edge or multiple edge recesses in both engaging edges of the side walls. Mating couplings, for example pin and socket couplings may also be provided to secure the box in the closed condition.

In order to allow the main walls of the box to engage appropriate recesses in the base plate, the side walls of the box halves may be set back from the edge of the main walls by a distance substantially equal to or slightly less than the depth of the slot(s) in the base plate.

The thickness of the container main walls is preferably arranged to be substantially the same as the width of the slot(s) into which they fit, so that a tight fit is provided to form a secure mounting of the walls of the construction on the base plate.

In order to enable plural containers to be mounted on the base plate back-to-back, one or more of the slots in the base plate may be of a width substantially twice the thickness of the container main walls so that two can be accommodated together in the same slot.

The container(s) and base plate are preferably formed of a generally rigid material so as to provide sufficient rigidity to the construction, but the material is preferably also slightly flexible to allow for easy assembly and disassembly. A particularly suitable material is polypropylene as the hinge(s) between the halves formed in such material have sufficient strength to resist rough use without separating.

When the container has a spine wall connecting the two halves of the box, the spine wall is advantageously shorter than the main walls of the box, i.e. closes the box without extending to the edge of the main walls at each end of the spine wall, so that the container can be located on the base plate with the main walls at right angles in complementary slots and the spine wall at an angle (most suitably 45°) to each main wall and thus resting not in a slot, but rather, simply, against the surface of the base plate. This enables substantially equal length orthogonal walls to be formed in the construction, facilitating the construction of plural rooms or areas on the base plate, but without requiring diagonal-/angled slots to be formed in the base plate, and enables a container to be positioned substantially anywhere on the surface of the base plate.

To enhance the play value of the system, plural different containers may be provided, each containing, for example, a different arrangement of accessories associated with rooms or the like of appropriate different types. It is envisaged, for example, that containers could be provided to form component parts of rooms such as bathrooms, bedrooms, kitchens, garages, and stables to name but a few possibilities, the interior of the box being provided with decorative inserts to imitate wall surfaces in the various rooms. The number and type of rooms that can be constructed is almost without limit.

Accessories may be hinged to the interior surfaces of the walls of the container so as to fold out when the box is opened and the interior surfaces may advantageously be provided with projections for mounting folding or other components.

Each container may have an outer transparent sleeve which extends around the main sides of the container and into which a display sheet may be fitted and which may be printed, on its reverse face with a representation of a wall surface, for example to simulate a brick or timber wall.

A second aspect of the invention includes a container of the type having a pair of halves connected by a spine wall which is shorter than the main walls of the container, as described above.

A third aspect of the invention is a base plate in the surface of which are provided a plurality of slots, and on one or more sides of which are provided means for enabling plural base plates to be connected together.

BRIEF DESCRIPTION OF THE DRAWINGS

One example of a play system according to the present invention will now be described with reference to the accompanying drawings, in which.

DESCRIPTION OF THE INVENTION

Figure 1:
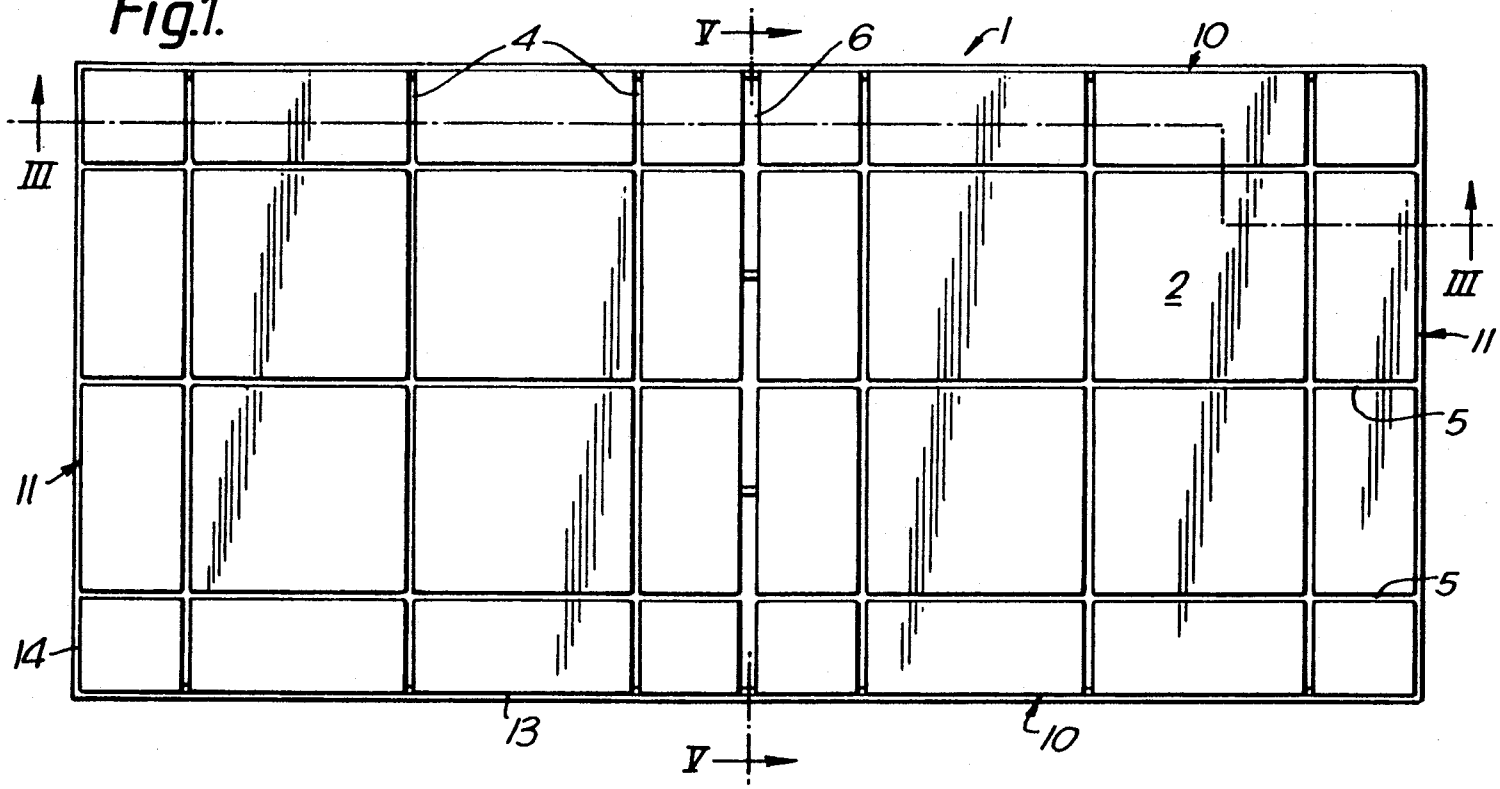
FIG. 1 is a plan view of a base plate member of the system.
Figure 8:
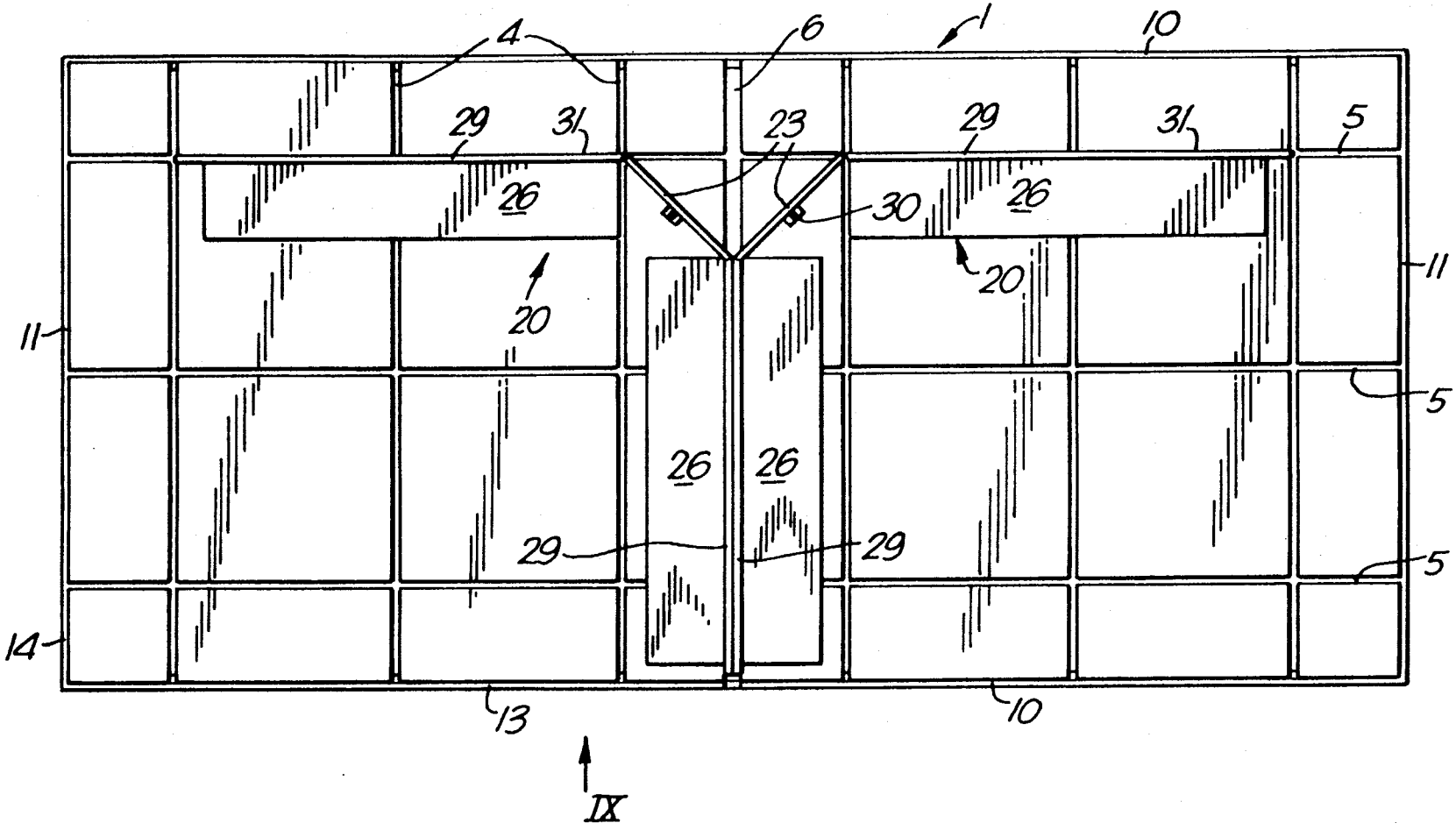
FIG. 8 is a plan view of the base plate with two containers mounted thereon.
Figure 9:
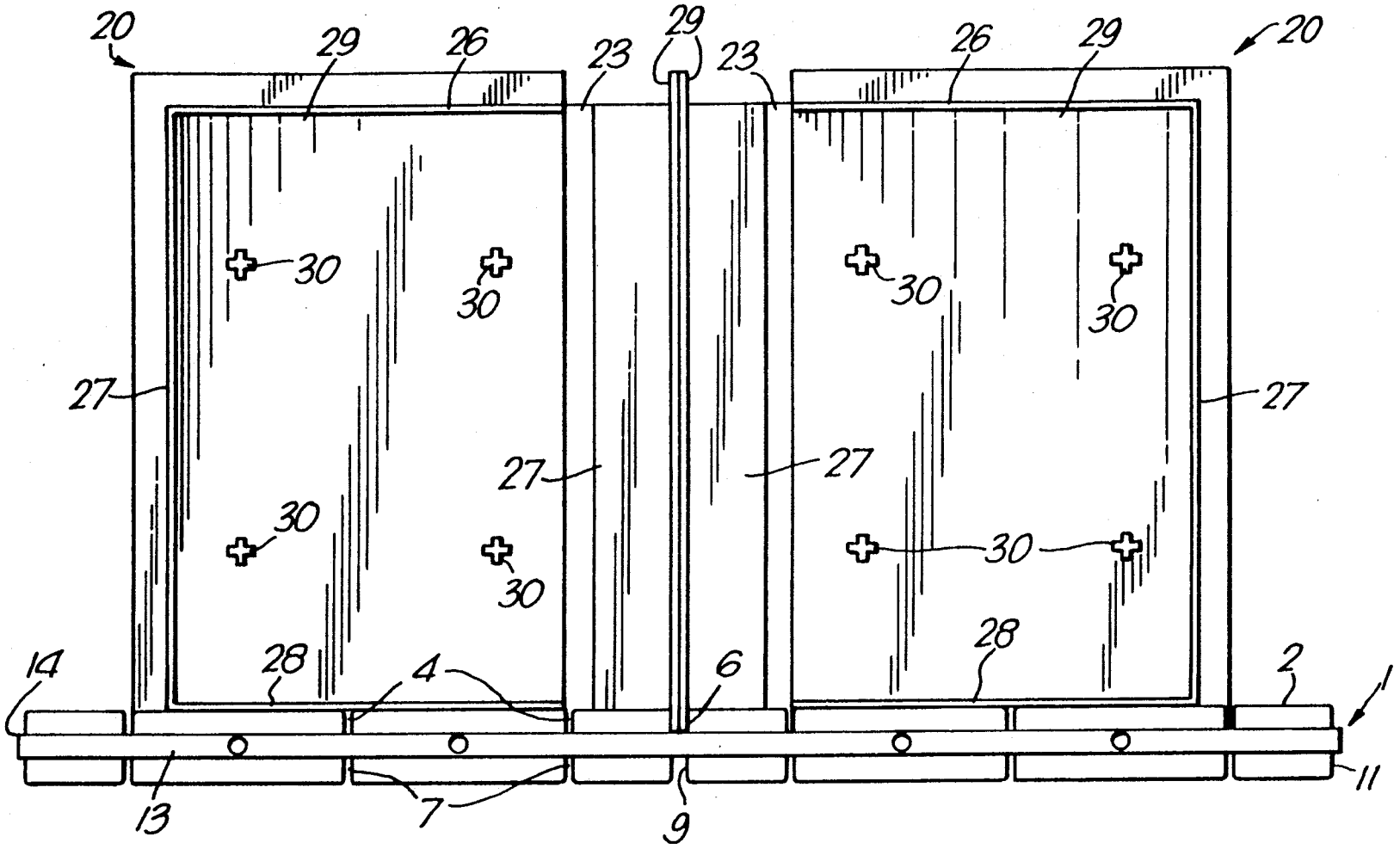
FIG. 9 is an elevation on arrow IX in FIG. 8.

The base plate 1 is formed from plastics, such as ABS, in a generally rectangular shape as can be seen in FIG. 1. In the top and bottom faces 2,3 are formed slots 4–9, the slots being arranged in two orthogonal sets on each face. The slots 4,5,6 in the top surface 2 are arranged as shown with the slot 6 being substantially twice the width of the slots 4,5 and parallel to the slots 4, which are substantially the same width as the thickness of the main walls of the containers 20 (to be described later). The reason for the double width is that it enables plural containers 20 to be mounted on the base plate back-to-back as shown in FIGS. 8 and 9. More than one of the slots in the base plate may be of a width substantially twice the thickness of the container main walls so that, for example, four containers could be mounted in a cruciform arrangement.

The four sides 10,11 of the base plate all have an integral spacer, 13,14 respectively, which, when the base plate is attached to another one, serves to provide a pair of double thickness slots (like the slots 6,9), top and bottom.

Figure 2:
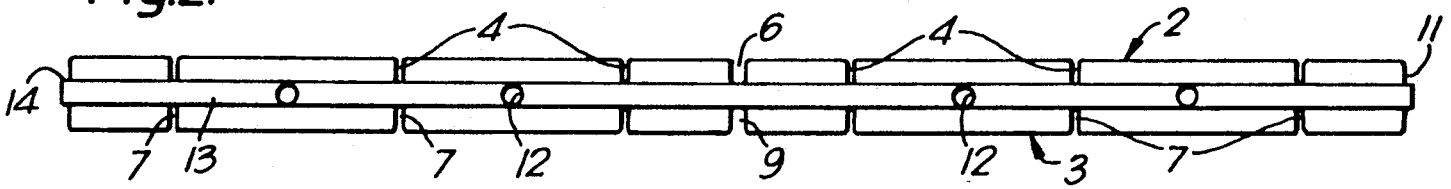
FIG. 2 is a side elevation of the base plate.
Figure 3:
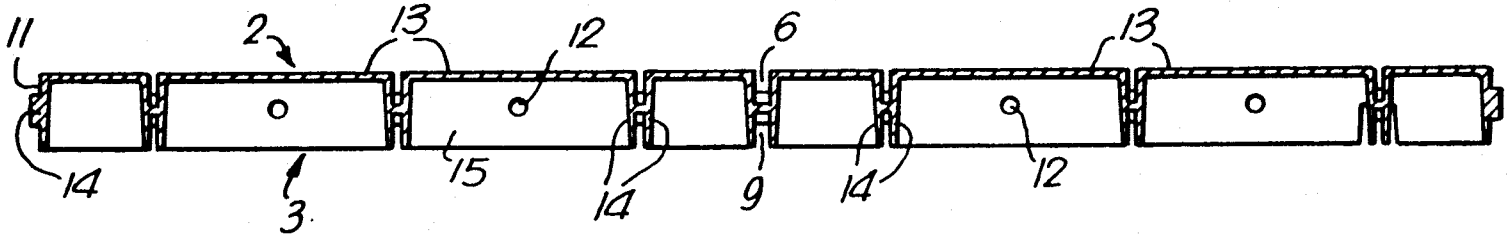
FIG. 3 is a cross-section on the line III—III in FIG. 1.
Figure 4:
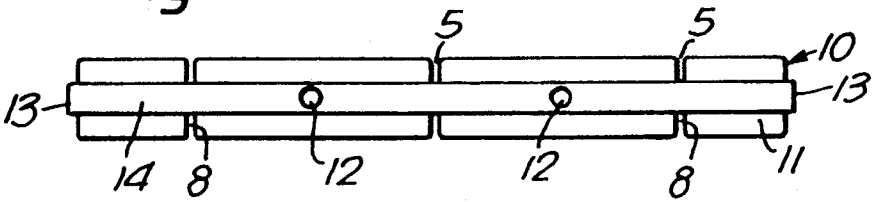
FIG. 4 is an end elevation of the base plate.
Figure 5:
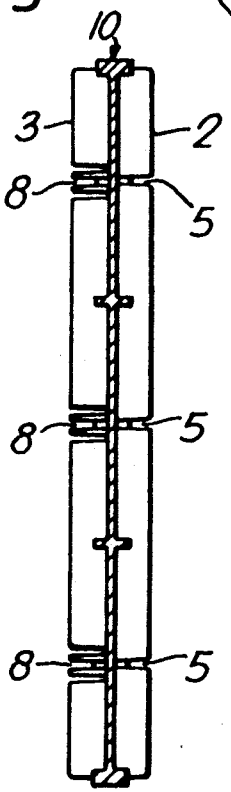
FIG. 5 is a cross-section on the line V—V in FIG. 1.

FIG. 2 is an elevation of one of the long side faces 10 of the base plate 1 and the arrangement of the slots 4,6,7,9 can clearly be seen, the slots being positioned precisely opposite one another on opposite faces 2,3. The side faces 10 contain apertures 12 which can be used to enable connection (by means of plastic nuts and bolts for example) of plural base plates in order to provide an enlarged base or roof when building a construction using the play system of the invention. FIG. 3 is a section on III—III in FIG. 1 and shows the formation of the walls which serve to make up the base plate. The top surface of the base plate is formed by plural walls 13 and the slots 4,5 by transverse walls 14,15. FIGS. 4 and 5 are views similar to FIGS. 2 and 3, but at right angles thereto. The end faces 11 also have apertures 12 to allow connection of other base plates.

Figure 6:
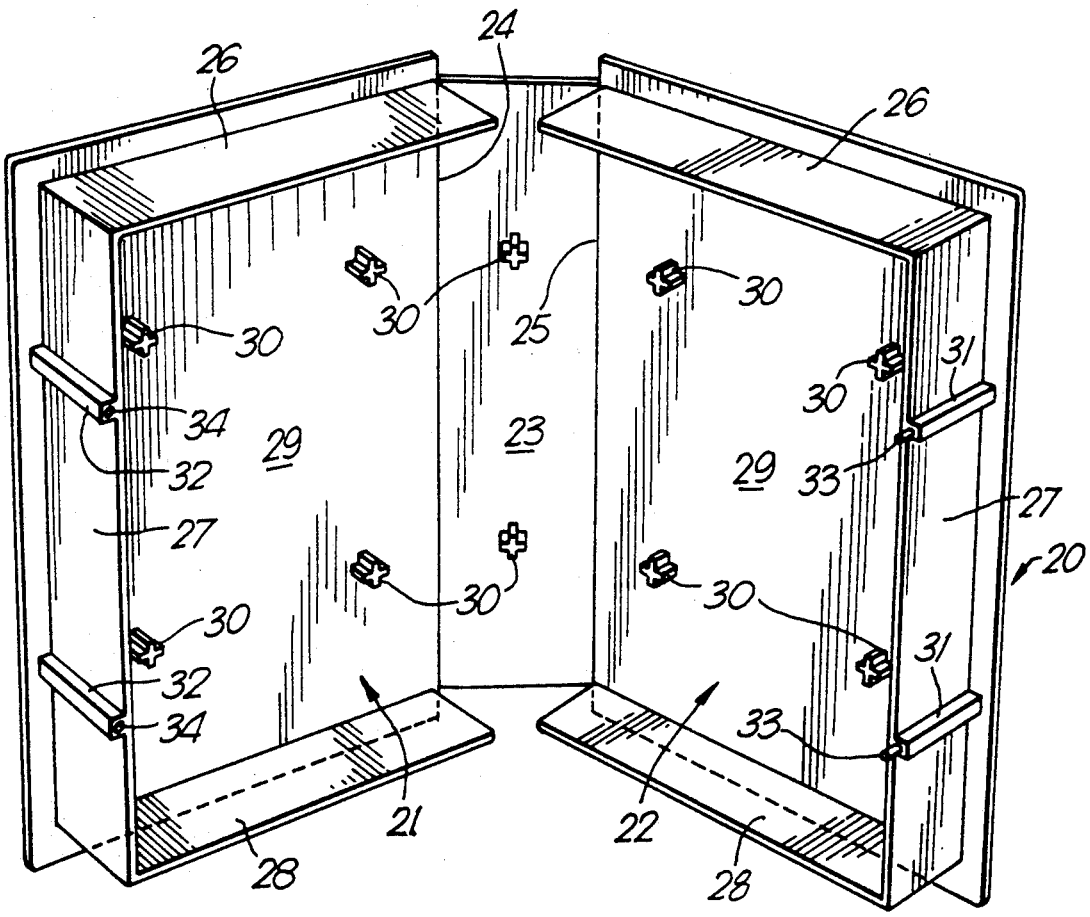
FIG. 6 is a diagrammatic perspective view of a container of the play system.
Figure 7A:
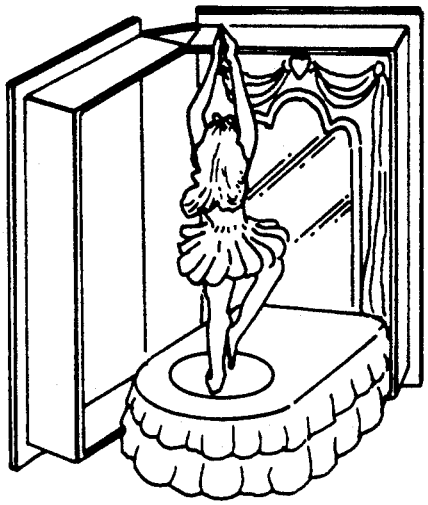
FIGS. 7A–D are smaller perspective views of containers of the system, showing accessories that have been inserted therein.
Figure 7B:
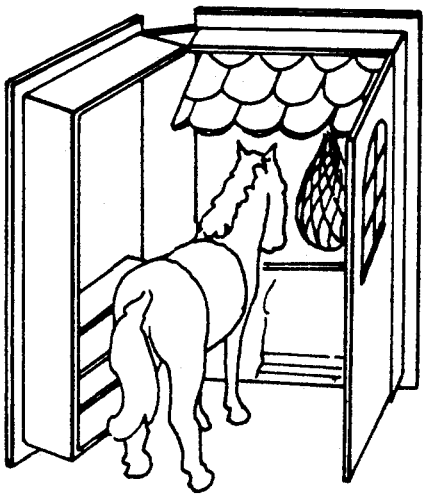
Figure 7C:
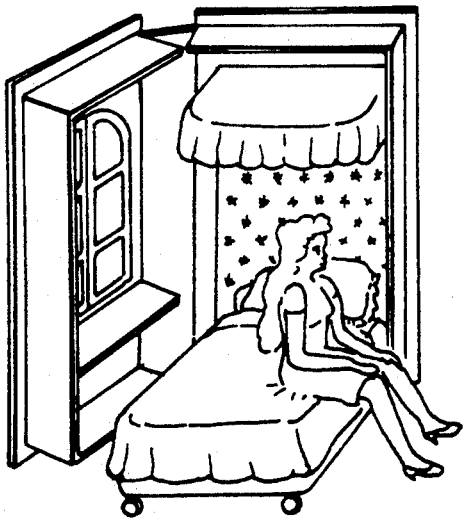
Figure 7D:
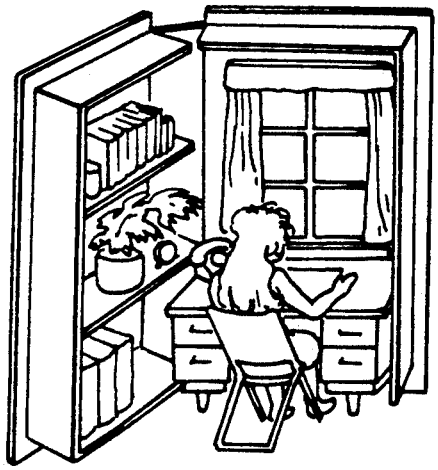

FIG. 6 shows an open container 20 in perspective. The container is formed of polypropylene. The container has two substantially identical halves 21,22 connected to one another through a spine 23 by integral hinges 24,25. Each half of the container has three side walls 26,27,28 and a main wall 29. The height of each side wall 26–28 is substantially half the width of the spine 23 so that, when the container is closed up, it forms a box which is substantially completely closed on all four sides. The side walls 26–28 are positioned on the respective main faces 29 set back from the edge of the main wall by a distance which is substantially the same as or slightly less than the depth of the slots 4–9 in the base plate 1, so that the edge portion of each main wall 29 can be disposed in one of the slots when building a construction with the play system, with the outside face of the adjacent side wall abutting the surface 2 or 3 of the base plate and thereby forming a secure connection.

It can be seen that the spine 23 has a length shorter than the length of the adjacent main walls 29 and this enables the spine to be disposed at an angle to the main walls when inserting the walls into the base plate, enabling the construction to have walls of the same length rather than of different lengths as would be necessary if the edge portions of the spine had to be accomodated in one of the slots with one of the adjacent main walls 29.

On the main walls 29 and the spine 23 there are provided cruciform-shaped projections 30 which enable accessories to be attached to the walls or spine.

Each side wall 27 includes a pair of connectors 31,32 respectively, for securing the container in the closed position. The connectors 31 have projecting spigots 33 and the connectors 32 have complementary holes 34.

FIGS. 7A–7D are diagrammatic views of four different styles of container that may be provided for use in constructing, for example a stage (FIG. 7A), a stable (FIG. 7B), a bedroom (FIG. 7C) and a study room (FIG. 7D) within a dolls' house. Each of the different containers has different accessories relevant to the intended room which the container provides and provides packaging also for the accessories.

Each container has a transparent sleeve which covers the main walls 29 and the spine 23 on the outside, into which a display sheet may be fitted and which may be printed, on its reverse face with a representation of a wall surface, for example to simulate a brick or timber wall.

FIGS. 8 and 9 illustrate an assembly of two containers on a single base plate, the containers 20 being positioned back-to-back with the lower edges of their respective main walls 29 disposed in the slots 5,6, the slot 6 accomodating one wall 29 of each container. It will readily be appreciated that additional containers can be mounted in similar fashion to provide additional walls of a construction such as a dolls' house. Likewise, the provision of slots 7,8,9 on the underside of the base plate 1 enable a roof or ceiling to be formed on the construction.

I claim:

1. A container for storing toy or game elements, the container having a pair of adjacent hinged halves each half comprising a main wall having outer marginal edge portions and upstanding flange portions spaced inwardly of said edge portions; and a spine wall, said main walls being connected by said spine wall, and said spine wall being shorter than the main walls of the container and having edge portions terminating with said flange portions said container being adapted to be used as a construction element in an upstanding manner upon a slotted surface of a base plate, wherein said marginal edge portions engage at least one of said slots so that said spine wall may abut the surface.

2. A container for housing one or more play elements and being adapted to be used as a construction element upon a slotted surface of a base plate, the container comprising a pair of adjacent hinged halves each half including a main wall having outer marginal edge portions and upstanding flange portions spaced inwardly of said edge portions; and a spine wall, said main wall of each half being connected by said spine wall, and said spine wall being shorter than the main walls and having edge portions terminating with said flange portions so that, in use, said marginal edge portions engage at least one of said slots and said spine wall abuts the surface.

3. A play system comprising:

a base plate, the base plate having a plurality of slots in at least one main surface thereof; and at least one container for a toy or game forming a construction having at least one upstanding wall portion when erected on said base plate comprising a box having a plurality of hinged together parts, at least one of the parts having a main wall portion, the main wall portion having an edge portion for selectively engaging one or more of the slots in said base plate to form the construction, the parts of the container including at least two adjacent hinged halves having outer marginal edges, each of said halves including side flanges set back in spaced relation from the marginal edges, when the box is closed, the flanges together forming side walls of the container, and the main walls lying opposite one another in confronting relationship when the container is closed; and said slots in said base plate have a width which is a multiple of the main walls for receiving at least one thickness of the container main walls.

4. A play system comprising:

a base plate, the base plate having a plurality of slots in at least one main surface thereof; and at least one container for a toy or game forming a construction having at least one upstanding wall portion when erected on said base plate, the container comprising a box having a plurality of hinged together parts, at least one of the parts having a main wall portion, the main wall portion having an edge portion for selectively engaging one or more of the slots in said base plate to form the construction built on said base plate from said container.

5. A play system according to claim 4, wherein said container contains play items.

6. A play system according to claim 1, wherein said base plate is generally rectangular and the plurality of slots includes plural sets of slots arranged orthogonally, parallel to the sides of the base plate.

7. A play system according to claim 1, wherein said base plate has two planar major surfaces, one on each side, and the slots are formed in both of said major surfaces.

8. A play system according to claim 4, wherein said base plate includes means for enabling said base plate to be connected to a further base plate in a plane.

9. A play system according to claim 1, wherein said container has two adjacent hinged halves having outer marginal edges, each of said halves including side flanges set back in spaced relation from the marginal edges, when the box is closed, the flanges together form side walls of the container, and the main walls lie opposite one another in confronting relationship.

10. A play system according to claim 9, wherein the main walls are connected by a spine wall which is hinged to both main walls to allow the box to open.

11. A play system according to claim 10, wherein said spine wall is shorter than said main walls of said container.

12. A play system according to claim 9, wherein said side walls on opposite halves engage one another to fully close the container.

13. A play system according to claim 12, wherein each side wall on at least one half of said container has an edge recess in one engaging edge for connection to the opposing side wall edge.

14. A play system according to claim 9, including mating couplings on said opposing side walls to secure said container in the closed condition.

15. A play system according to claim 9, wherein, in order to allow the main walls of said container to engage appropriate recesses in said base plate, the flanges are set back from the edge of the main walls a distance up to the depth of the slots in said base plate.

16. A play system according to claim 9, wherein the thickness of said main container main walls is substantially the same as the width of at least a first set of said slots in said base plate, whereby said walls are a tight fit in said slots to provide a secure mounting of the walls of the construction on said base plate.

17. A play system according to claim 16, wherein, in order to enable plural ones of said container to be mounted on said base plate back-to-back, at least one of said slots in said base plate are of a width substantially twice the thickness of the container main walls.

18. A play system according to claim 4, wherein said container is formed of polypropylene.

19. A play system according to claim 4, which includes plural different containers, said different containers each containing a different arrangement of accessories.

20. A play system according to claim 4, wherein each side of said base plate includes a spacer, whereby a slot is provided between the base plate and an adjacent base plate when they are connected together.

* * * * *